United States Patent [19]

Husted

[11] 3,964,560

[45] June 22, 1976

[54] POWER DRIVEN SKI

[75] Inventor: Royce H. Husted, Wheaton, Ill.

[73] Assignee: Saroy Engineering, Wheaton, Ill.

[22] Filed: Feb. 20, 1975

[21] Appl. No.: 551,111

[52] U.S. Cl. ..... 180/5 R; 280/11.11 E

[51] Int. Cl.[2] ..... B62M 27/00

[58] Field of Search..... 180/5 R; 74/229, 107, 74/214; 280/11.11 E; 428/89, 90, 97; 188/82.77, 25

[56] References Cited

UNITED STATES PATENTS

| | | | |
|---|---|---|---|
| 3,143,895 | 8/1964 | Robie | 74/229 |
| 3,617,426 | 11/1971 | Grundman | 428/65 |
| 3,853,192 | 12/1974 | Husted | 180/5 R |

*Primary Examiner*—Philip Goodman
*Attorney, Agent, or Firm*—Samuel Shiber

[57] ABSTRACT

A power driven ski with an anterior sliding portion and posterior one-way snow engaging endless belt portion, a motor for propelling the belt and control means attached to a ski pole for regulating the belt's speed.

1 Claim, 3 Drawing Figures

POWER DRIVEN SKI

SUMMARY AND BACKGROUND

This invention relates to skis, and more particularly to a ski having means of carrying a skier over snow covered surface under its own power.

As has been discussed in my U.S. Pat. No. 3,853,192 which is herein incorporated by reference, presently, there is a polarization between outdoor winter sports' enthusiasts. The purists use nothing but skis, while the modernists take their relaxation along with their recreation and mount a snowmobile.

Applicant's invention provides the skier on one hand with some of the challenges, such as holding balance, etc., of downhill skiing without the dependency on hilly terrain and ski lifts, and on the other hand it is much less cumbersome to use, to transport and to store than the snowmobile, and less expensive to produce and maintain. The power driven ski comprises an anterior elongated sliding ski portion which is similar to the anterior portion of a conventional ski. To this section, the skier's boot is attached by a conventional binding mechanism. The posterior ski portion is made of an endless belt fit to engage with snow and resist slippage in one direction, but to offer a minimal resistance and drag to sliding over the snow in the opposite direction. It is important that the posterior portion of the ski evenly packs and compresses the snow from above while the endless belt is obtaining a forward thrust from the packed snow. Without this even packing, the snow, especially if in powdery form, is easily blown away from under the belt. Thus, it is also important to proportion the anterior and posterior ski portions, and to locate the binding mechanism so that some of the skier's weight will be utilized to evenly compress and pack the snow through the posterior ski portion. In order to obtain an even packing under the belt, the power driven ski is preferably constructed with a dihedral angle somewhat smaller than 180° between its anterior and posterior portions, when the ski is free of skier's weight, so that under skier's weight, the ski would be straightened, distributing skier's weight along the posterior and anterior ski portions. The motor utilized is preferably an internal combustion engine. It can be mounted directly on the ski or carried by the skier on his back or belt (The reader should keep in mind the ultra light engines on the type utilized in chain saws, weighing 4–8 lbs., which develop several H.P.). If carried by the skier it can be coupled by a flexible shaft to the endless belt, or by a hydrostatic drive. The drive line between the motor and the endless belt can include clutching and/or speed changing mechanism, prefarably a centrifugal clutch or a miniature hydrokinetic torque converter.

A skier may bind a power ski to each of his legs, or bind a power ski to one leg and a conventional ski to the other leg.

DETAILED DESCRIPTION OF THE FIGURES

Figure 1:
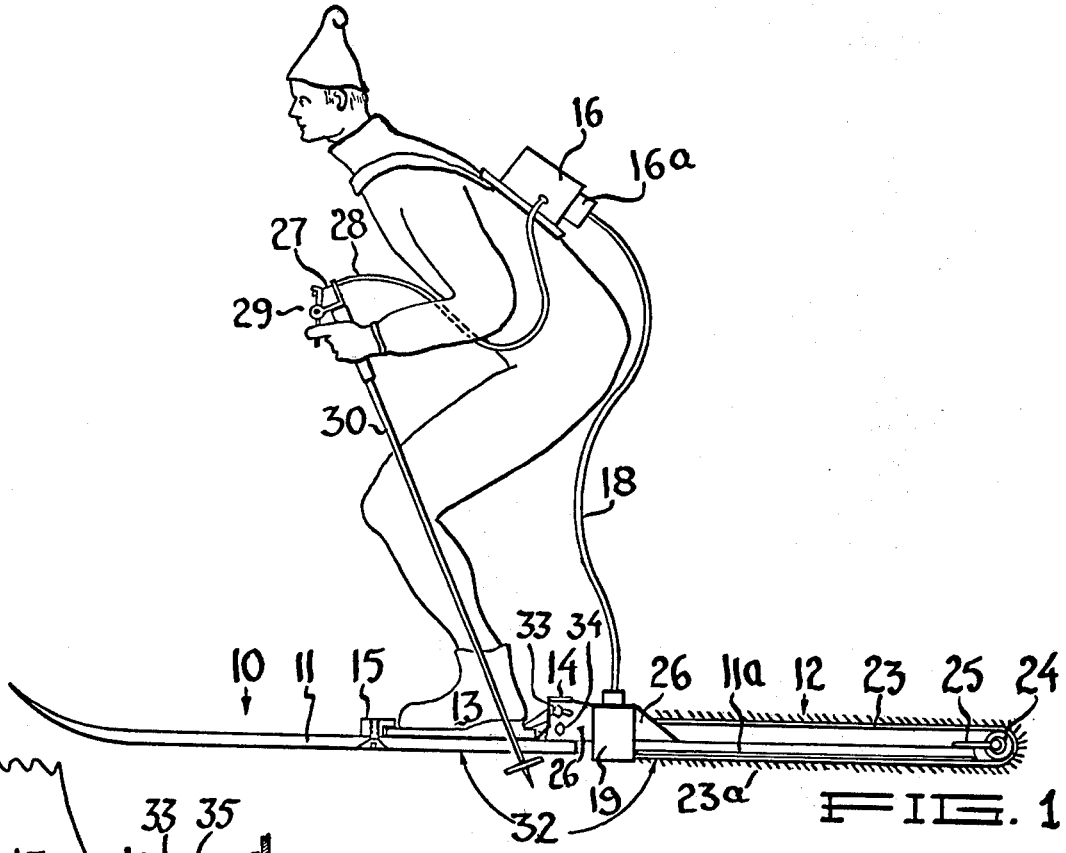
FIG. 1 shows a side view of a skier equipped with a power driven ski according to my invention.
Figure 2:
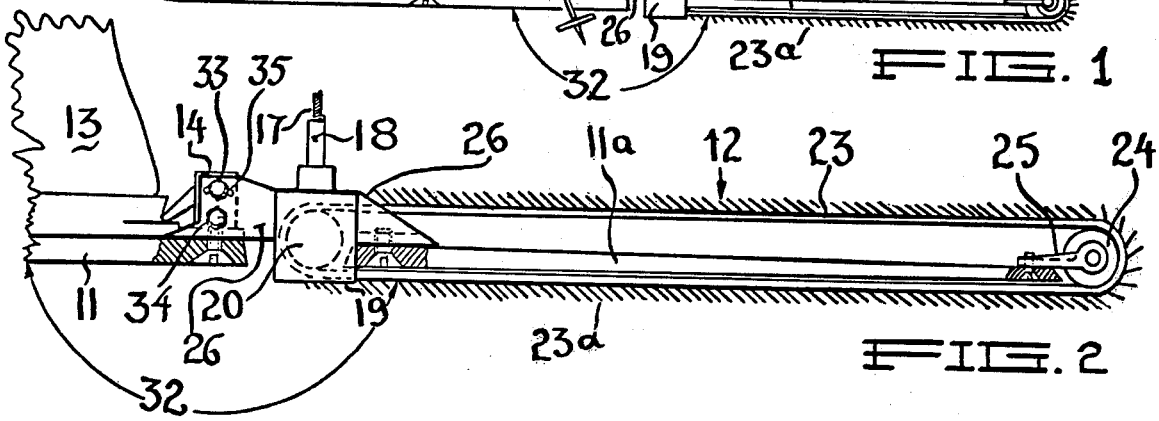
FIG. 2 shows a side view of the posterior section of the power driven ski shown in FIG. 1.
Figure 3:
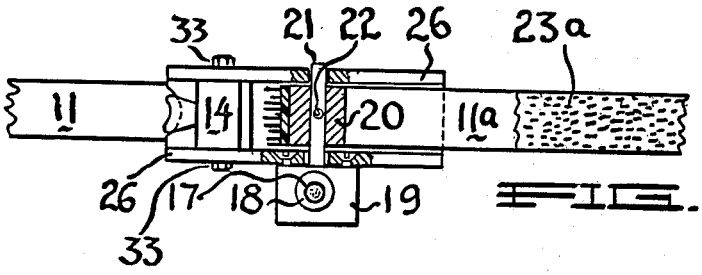
FIG. 3 shows a top view of the center section of the power driven ski shown in FIG. 1.

FIGS. 1, 2 and 3 show a power driven ski generally indicated by numeral 10, having an anterior elongated sliding ski surface portion 11 for slidingly-contacting the snow, and a posterior endless belt portion generally indicated by numeral 12, for driving the ski. A skier's boot 13 is attached to the ski by a conventional "step in" type ski binding mechanism indicated by numerals 14 and 15.

The skier carries on his back a motor 16 which transmits its power to a right angle gear box 19 through a hydrokinetic torque converter **16*a* and a flexible shaft having a core 17, and an outer protective cover 18. A driver pulley 20 is mounted on the output shaft 21 of the gear box 19 and secured to it by a spring pin 22**.

An endless belt 23 is rotatably supported on the driver pulley 20 and on an idler pulley 24 which is rotatably supported on a rear fork 25 which is secured to a posterior ski section **11*a***.

The endless belt 23 must have certain, specific, snow engaging characteristics in order for the power driven ski as a whole to achieve its objective, and a discussion of these characteristics and objective may be proper at this point:

One of the unique aspects of skiing on power driven skis is obviously being propelled by a motor ("power skiing"), however, intermittently the skier will ski without the benefit of the motor's power ("power-less skiing"). Several examples to conditions in which power-less skiing occurs are when a skier encounters a downgrade, when the motor's power is cut down either intentionally by the skier or by a mishap, or during extensive maneuvering. It is understandable that during the power skiing mode it is necessary for the belt to engage the snow, however, since the power skiing mode may be intermittently and suddenly superceded with the power-less mode it is desirable to minimize the engagement and friction between the belt 23 and the snow so as to prevent the skier from being thrusted forward — off balance — during such a sudden, unexpected switch from the power to the power-less mode of skiing. In order for the belt to have these one-way snow engaging characteristics it is constructed with outwardly protruding bristles **23*a*** which are rearwardly inclined (as viewed on the belt portions which contacts the snow). These bristles tend, automatically, to self-energizingly erect into, and positively engage with the snow during the power skiing mode, and to automatically disengage from the snow and flatten against the belt during the power-less skiing mode. It may be noted that such belt material is commercially available from, for example, the Minnesota Mining and Manufacturing Company, located in St. Paul, Minn. under the name "Fibre Tran". Similar belt materials and processes of manufacturing them are described in U.S. Pat. Nos. 2,563,257, 2,941,410, 3,143,895, 3,275,487, 3,436,245, 3,617,426, 3,654,777, 3,687,251, and 3,710,905, which are herein incorporated by reference. Thus, in essence the belt and snow mutually co-operate to form a one-way clutch type of a system in which the engagement or disengagement is instantaneous and free from inertial reaction or shock due to the lightness of the bristles.

The anterior and posterior ski sections 11 and 11a respectively, the ski binding mechanism 14 and the right angle gear box 19 are all secured to a central frame 26. A flexible cable having a core 27 and a protective cover 28 connects a trigger mechanism 29 which is mounted on a ski pole 30 to the motor 16 regulating motor's power output to the endless belt.

Numeral 32 indicates a dihedral angle between the anterior and posterior portions of the ski, 11 and 11*a* respectively, which is somewhat smaller than 180° when the ski is free of skier's weight.

This construction of the ski helps to even the weight distribution of skier's weight along the ski. The size of the ideal dihedral angle depends on the ski's stiffness, length and width as well as on skier's weight, thus it is possible to design a mechanism that will allow to adjust the dihedral angle to suit. Such a mechanism consists of bolts 33 and 34 and slot 35 in the center frame 26, which allow the skier to secure the binding mechanism 14 to the center frame 26 in different angles resulting in a different dihedral angle 32, since the anterior ski portion 11 is secured to the center frame 26 through binding mechanism 14. An additional benefit of this construction is that the anterior portion of the ski 11 is readily separable from the rest of the power ski 10, which can ease transporting the power ski in the trunk of a car or substituting one anterior portion of ski with another portion having a different length, width or stiffness characteristics to suit a particular snow condition or a particular skier. While the invention has been illustrated in connection with a specific embodiment, it is understood that various changes may be made in the form, details arrangement and proportions of the various parts without departing from the scope of the invention.

I claim:

1. In a power driven ski having in combination;

an anterior elongated sliding ski surface portion for slidingly contacting the snow, a posterior one-way snow engaging endless belt portion for driving said ski, means for connecting said anterior portion to said posterior portion, means for attaching said ski to a skier's boot, and motor means for powering said endless belt portion, said motor means being coupled to said endless belt portion, the improvement wherein said one-way snow engaging belt has outwardly protruding means which automatically disengage from the snow and flatten against the belt during power-less skiing and automatically erect into and engage with snow during power skiing.

* * * * *